US009174244B2

(12) United States Patent
Gunnerson et al.

(10) Patent No.: US 9,174,244 B2
(45) Date of Patent: Nov. 3, 2015

(54) SYSTEM AND APPARATUS FOR SEPARATING AND ORIENTING SAMPLE CONTAINERS

(71) Applicant: Nautilus Systems, Inc., Phoenix, AZ (US)

(72) Inventors: Steve Gunnerson, Peoria, AZ (US); Eric Moore, Waddell, AZ (US)

(73) Assignee: Nautilus Systems, Inc., Phoenix, AZ (US)

( * ) Notice: Subject to any disclaimer, the term of this patent is extended or adjusted under 35 U.S.C. 154(b) by 47 days.

(21) Appl. No.: 13/902,682

(22) Filed: May 24, 2013

(65) Prior Publication Data

US 2014/0102954 A1 Apr. 17, 2014

Related U.S. Application Data

(60) Provisional application No. 61/651,386, filed on May 24, 2012.

(51) Int. Cl.

| | |
|---|---|
| ***B07C 5/00*** | (2006.01) |
| ***B07B 13/00*** | (2006.01) |
| ***B07C 5/02*** | (2006.01) |
| ***B07C 5/36*** | (2006.01) |

(52) U.S. Cl.

CPC . *B07B 13/00* (2013.01); *B07C 5/02* (2013.01); *B07C 5/36* (2013.01)

(58) Field of Classification Search

CPC ..... B07B 13/00
USPC ..... 209/522, 539, 621, 659, 667, 674, 681
See application file for complete search history.

(56) References Cited

U.S. PATENT DOCUMENTS 3,722,674 A * 3/1973 Hoppmann et al. ..... 209/666
5,853,077 A * 12/1998 Schmitt ..... 198/383

* cited by examiner

*Primary Examiner* — Terrell Matthews
(74) *Attorney, Agent, or Firm* — Zeman-Mullen & Ford, LLP

(57) ABSTRACT

A system and apparatus for separating/sorting and orienting/aligning tubes and/or vials or other sample containers.

24 Claims, 9 Drawing Sheets

SYSTEM AND APPARATUS FOR SEPARATING AND ORIENTING SAMPLE CONTAINERS

CROSS-REFERENCE TO RELATED APPLICATIONS

This application claims priority to provisional patent application having Ser. No. 61/651,386, filed May 24, 2012, which is herein incorporated by reference in its entirety.

FIELD OF INVENTION

The present invention is directed to a system and apparatus for separating and orientating tubes and/or vials that are typically used in industries and institutions that utilize tubes and vials for diagnostics, sample storage, and other applications. The system and apparatus for separating/sorting and orienting tubes and/or vials (or other cylindrical storage type devices) includes a tube/vial feeder with a hopper and one or more interchangeable selector disks, an output chute and output conveyer, and an orientator capable for sensing and changing the orientation of tubes/vials.

BACKGROUND OF THE INVENTION

Numerous industries use tubes, vials, and similar sample containing devices for collecting samples, storing samples, and later testing samples. For example, in the medical and forensic fields, test tubes with stoppers or caps and/or vials with stoppers or caps are regularly used for collecting samples such as urine samples, blood samples, tissue samples, etc., and storing such samples for later testing of the samples. In addition, tubes and vials with stoppers or caps are also often used as culture tubes in biology for handling and culturing all kinds of live organisms such as molds, bacteria, seedlings, plant cuttings, etc. Tubes and vials are also used in the chemical industry field for storing, handling, and/or testing all kinds of chemicals in a variety of forms such as solids, liquids, and gas.

In practice, a great deal of time and effort can be expended in sorting and orientating such tubes and/or vials for further use and processing. For example, if many tubes and/or vials of various sizes containing different samples are mixed together or stored together, these tubes and/or vials must be separated in order to ensure that further appropriate processing is performed on the samples contained in the various tubes and/or vials. In another example, if numerous samples are collected at the same time in various sizes of tubes and/or vials and are later required to be stored in different storage environments, the tubes and/or vials must be separated and may need to be properly oriented for appropriate storage. In still another example, a number of various sized empty tubes and/or vials may need to be separated and orientated in preparation for sample collection and/or storage.

Accordingly, there is a need for a system and apparatus for separating and orientating sample containers, such as tubes and vials, for example, that is capable of efficiently and effectively sorting and aligning the sample containers.

SUMMARY OF THE INVENTION

The present invention is directed to a system and apparatus for sorting sample containers such as sample tubes and/or sample vials, for example, and orienting and/or aligning the sample tubes and/or sample vials in a predetermined orientation or alignment after they are sorted. The present invention is also capable of sorting and orienting sample containers that include a stopper element or cap element.

In one exemplary embodiment, the apparatus for sorting sample containers of the present invention includes a hopper having a pass through opening, at least one selector disk having at least one opening where the selector disk is removably secured to the hopper, and an output member for receiving a sample container which passes through the opening(s) in the selector disk and the pass through opening in the hopper. In another exemplary embodiment, the sorting apparatus of the present invention also includes an orientation device in communication with the output member which is capable of orienting and/or aligning the sample containers in the same predetermined orientation and/or alignment after they are received by the output member subsequent to sorting by the selector disk. In still another exemplary embodiment, the output member includes an output chute and an output conveyer.

The selector disk may include a plurality of same sized openings positioned at evenly distributed locations about the circumference of the selector disk. Another embodiment of the invention may include a plurality of exchangeable selector disks each having a different sized opening contained therein. Each of these plurality of selector disks may also have a plurality of same size openings (with each selector disk itself having a different size opening) positioned at evenly distributed locations about their circumference.

A selector disk rotate motor and gearbox may be used to rotate the selector disk and the apparatus may also include a disk knob to enable and facilitate removal and installation of the selector disk(s). The selector disk(s) may include one or more agitator members which function to agitate and move the sample containers in the hopper in order to increase the opportunity for the sample containers to align with, and fall into, the openings within the selector disk(s). The selector disk(s) may include a plurality of agitator members that are positioned at evenly distributed locations about the radius of the selector disk(s). The apparatus may also include a sensor in communication with the hopper (either directly or through some type of overall system controller) to sense when a sample container passes through an opening in the selector disk and the pass through opening in the hopper.

The sorting apparatus of the present invention may further include a scanning sensor that is capable of determining if the sample container is in a desired orientation after being received by the output member. An orientation device in communication with the scanning sensor (either directly or through some type of overall system controller) is capable of rotating the sample container to the desired orientation if the sample container is not already positioned in the desired orientation after being received form the output member. The orientation device may be capable of rotating the sample container 180 degrees in one or more directions.

The sorting apparatus of the present invention may be controlled by a system controller that is capable of controlling at least one or more of the rotation of the selector disk, sensors capable of sensing sample containers, the output conveyer, the scanning sensor, and the orientation device. In addition, other devices or instruments may be connected to the output conveyer that extends beyond the orientation device after orienting the sample containers to receive the oriented sample containers for further processing, transit, and/or storage. The system controller monitors the apparatus components and the sample containers moving through the apparatus to provide the maximum possible feed rate for the sample containers in a controlled fashion.

In another exemplary embodiment, the apparatus for sorting sample containers of the present invention includes a hopper having a pass through opening, a selector disk having at least one opening therein where the selector disk is removably secured to the hopper, an output member for receiving a sample container which passes through an opening in the selector disk and the pass through opening in the hopper, a scanning sensor capable of determining if the sample container is in a desired location after being received by the output member, and an orientation device capable of rotating the sample container to the desired orientation if the sample container is not positioned in the desired location. Either the embodiment of the invention that only includes the sorting elements or the embodiment of the invention that includes both the sorting elements and the orientation elements may include sensors that are controlled by a system controller which enables an opening in the selector disk to be rotated to align with the pass through opening in the hopper when it senses that a sample container is present within an opening in the selector disk. In addition, either embodiment may include a plurality of exchangeable selector disks each having a plurality of openings therein where the size of the plurality of openings are different for each selector disk.

In still another exemplary embodiment, the sorting apparatus of the present invention includes a hopper having two or more pass through openings, at least one selector disk having two or more different sized and/or shaped openings where the selector disk is removably attached to the hopper, two or more output members capable of receiving sample containers passing through the different sized and/or shaped openings in the selector disk and the two or more pass through openings in the hopper, respectively, so that each output member receives a sample container having at least one of a specific size and a specific shape. Each output member may include an output chute and an output conveyer. In addition, the apparatus may include a scanning sensor for each output member where each scanning sensor is capable of determining if the sample container is in a desired orientation after being received by its respective output member. The apparatus may further include an orientation device for each scanning sensor where each orientation device is capable of rotating the sample container to a desired orientation after being received by the output member associated with the respective scanning sensor.

Additional exemplary embodiments and features of the system and apparatus of the present invention for sorting and then orienting and/or aligning sample containers, as well as the operation for sorting and then orienting and/or aligning the sample containers, are further described below.

BRIEF DESCRIPTION OF THE DRAWINGS

The subject invention will hereinafter be described in conjunction with the appended drawing figures, wherein like numerals denote like elements.

DETAILED DESCRIPTION

Figure 1:
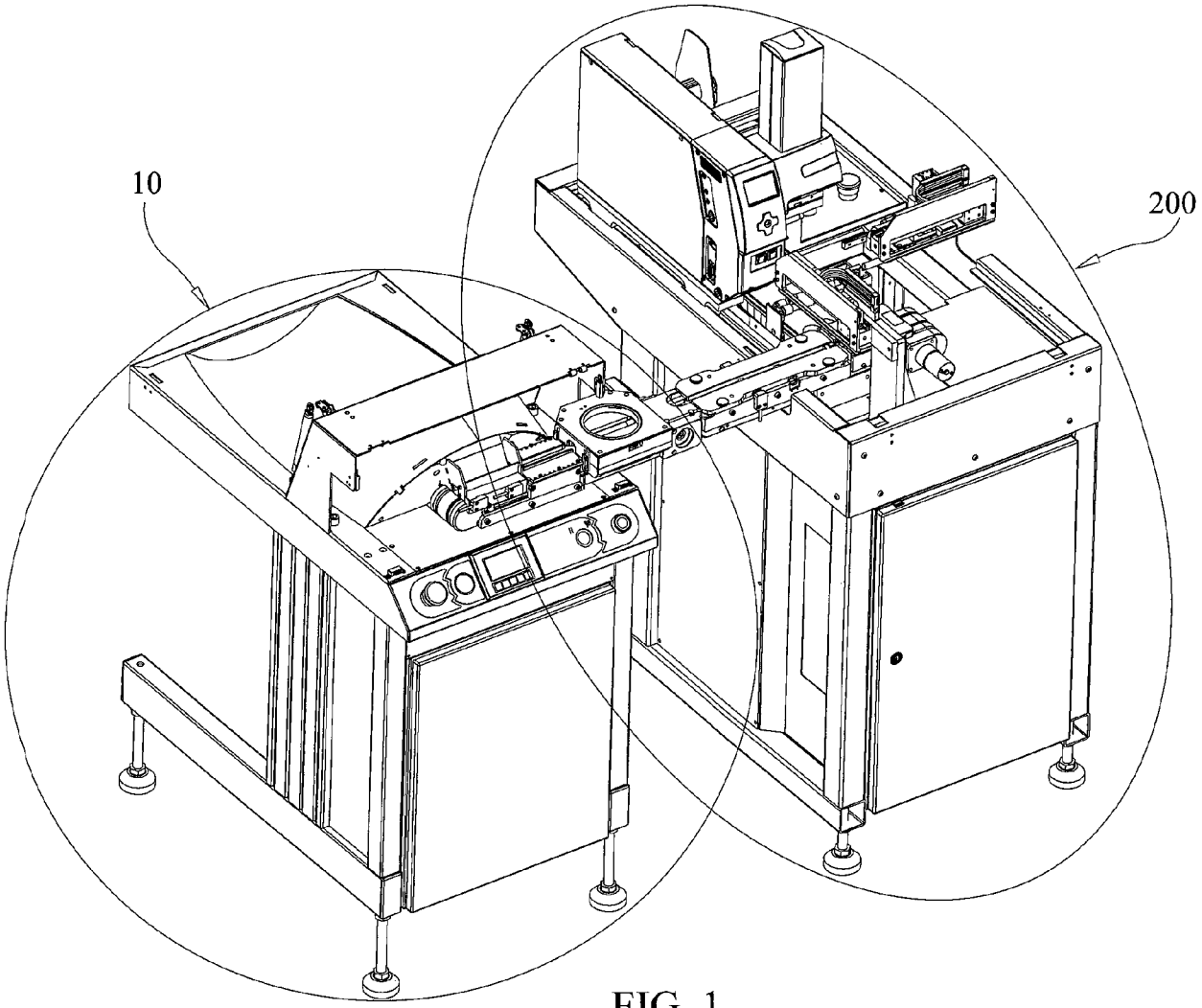
FIG. 1 is a perspective view of the system and apparatus for sorting and orienting sample containers of the present invention shown connected to another device which receives the sample containers after they are sorted and properly oriented by the apparatus of the present invention.

The present invention is directed to a system and apparatus for separating/sorting and/or orienting/aligning sample containers such as tubes and vials. It is an apparatus developed specifically for feeding tubes and vials of the typical types used in laboratories and other institutions requiring tubes and vials for diagnostics, sample storage, and other related applications.

System Components

The system and apparatus of the present invention consists of several major components including:

1) Hopper—The Hopper, manufactured from materials that are applicable for a laboratory or medical facility such as stainless steel, provides a location where the user may deposit a large quantity of a specific size and shape of a sample container such as a Tube or Vial. The Tubes or Vials may be empty, filled partially or completely, and with or without caps. The Hopper geometry is designed specifically to cause Tubes or Vials to move toward the Selector Disk as the system consumes Tubes or Vials due to gravity and a low friction Hopper surface. Affixed to the Hopper are sensors used to identify the position of the Selector Disk as it rotates, to confirm if a Tube or Vial is present in a Selector Feature, and to confirm when a Tube or Vial exits the Hopper and enters the Output Chute. These sensors are monitored by the System Controller. Large quantities of sample containers having different sizes and/or shapes may also be deposited in the Hopper and sorted in accordance with another embodiment of the invention that includes two or more pass through openings in the hopper having different shapes and/or sizes and a selector disk having openings therein having two or more different shapes and/or sizes.

2) Selector Disk—The Selector Disk is a disk-shaped component with several Selector Features (Openings), shaped according to the Vial or Tube that will run with the Selector Disk, at evenly distributed locations about the circumference of the Selector Disk. The Selector Features (or Selector Openings) are designed to allow a Tube or Vial to fit into the Feature/Opening with symmetrical features to ensure good fit regardless of the orientation (for example, cap side leading or cap side trailing) of the Tube or Vial. The Selector Disk includes features to allow the System Controller to control and command the position of the Selector Disk. The Selector Disk is an interchangeable component that allows the system and apparatus of the present invention to be transformed quickly from running one particular Tube or Vial type to a different Tube or Vial type. In another previously described embodiment of the invention, the Selector Disk may have two or more Openings of different sizes and/or shapes so that it can sort two or more sizes and/or shapes of sample containers at the same time.

3) Disk Knob—The Selector Disk is affixed to the Selector Disk Rotate Motor and Gearbox by the Disk Knob. The Disk Knob can be manually removed to allow for rapid changeover between various Selector Disks.

4) Agitators—The Agitator members are affixed to the Selector Disk. The Agitator members, as a result of the rotating motion of the Selector Disk, agitate and move the Tubes or Vials in the Hopper, improving the opportunity for Tubes or Vials to align with and fall into the Selector Features/Openings during rotation.

5) Output Chute—At the 'top dead center' position in the Hopper a pass-thru feature (or pass through opening) exists such that as the Selector Disk rotates if any Selector Feature contains a Tube the Tube will fall, by gravity, out of the back side of the Hopper and onto the Output Chute. The Output Chute guides the Tube or Vial onto the Output Conveyor. In another previously described embodiment of the invention, the Hopper may have two or more pass through openings of different shapes and/or sizes that correlate with the two or more Openings in the Selector Disk that have different sizes and/or shapes so that it can sort two or more sizes and/or shapes of sample containers at the same time.

6) Output Conveyor—The Output Conveyor motion is controlled by a variable speed motor. The Output Conveyor moves the Tube and the necessary speed to the Scanning Sensor, thru the Orientator, and finally off the end of the Output Conveyor to whatever output system is adjacent to the Output Conveyor. In another previously described embodiment of the invention, there is an output chute for each of the different sized and/or shaped openings in the Selector Disk and the correlating different sized and/or shaped pass through openings in the Hopper so that sample containers having different sizes and/or shapes pass down their own output conveyer.

7) Scanning Sensor—The Scanning Sensor measures the diameter of each Tube or Container as it passes through the sensor beam. The Scanning Sensor output determines if the Tube or Container is moving along the Output Conveyor in the desired orientation.

8) Orientator (or Orientation Device)—The Orientator device provides a rotating motion. As each Tube or Vial passes through the Orientator the System Controller, based on the feedback values from the Scanning Sensor, determines if that Tube or Vial is in the desired orientation. If the Tube or Vial is not in the correct orientation the System Controller causes the Orientator to rotate 180 degrees such that the Tube or Vial is re-orientated to the desired orientation. The rotation of the Orientator occurs simultaneous to the motion of the Output Conveyor. The Orientator contains sensors to confirm the presence of a Tube or Vial and the rotation of the Orientator when it occurs. In another previously described embodiment of the invention, where sample containers of two or more shapes and/or sizes are sorted at the same time, a separate scanning sensor and a separate orientation device are included for each output conveyer.

9) System Controller—The System Controller controls and monitors all activity of the Tube and Vial Feeder. It includes capacity for management of digital I/O points, servo or stepper motors, DC electric motors and all other necessary functions. It may also include a panel for human-machine interface. The System Controller is normally enclosed in an appropriately rated electrical controls enclosure.

Figure 2:
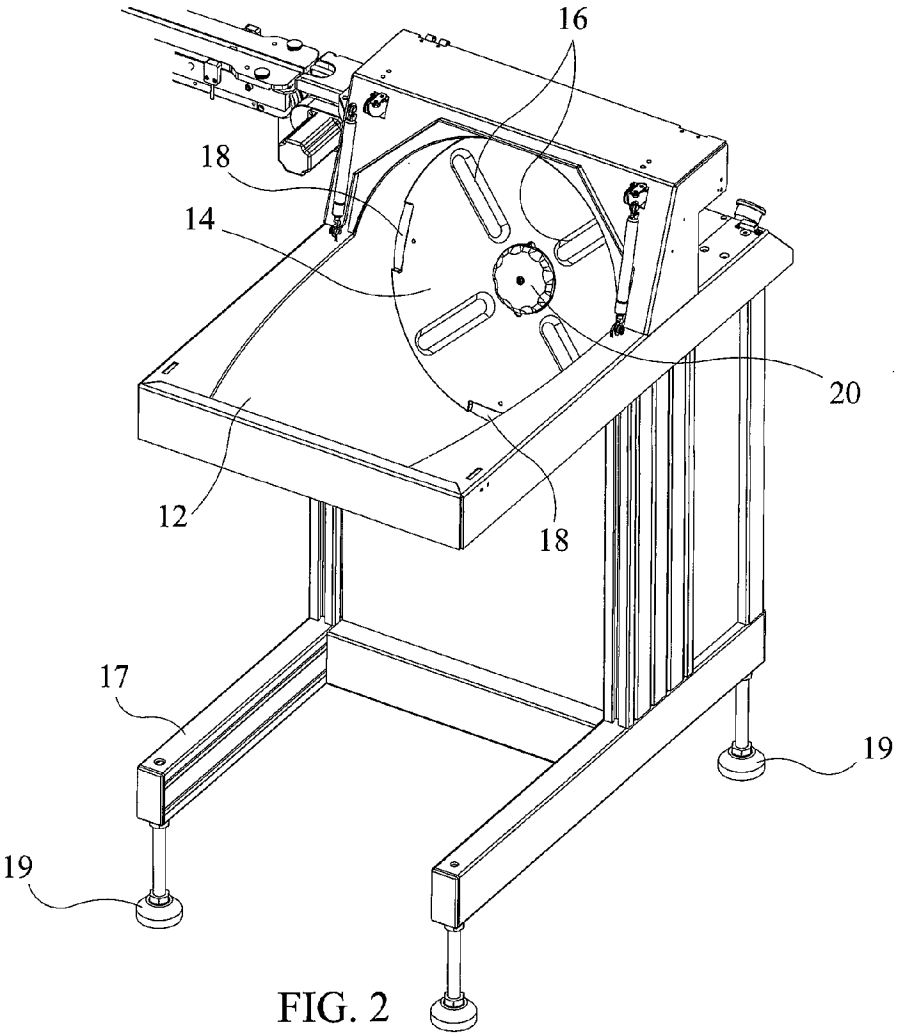
FIG. 2 is a rear perspective view of a portion of the apparatus of the present invention for sorting and orienting sample containers which shows the hopper and the selector disk of the apparatus.

FIG. 1 is a perspective view of the system and apparatus 10 for sorting and orienting sample containers of the present invention shown connected to another device 200 which receives the sample containers after they are sorted and properly oriented by the apparatus 10 of the present invention. A rear perspective view of a portion of the apparatus 10 of the present invention for sorting and orienting sample containers which shows the hopper 12 and the selector disk 14 of the apparatus is shown in FIG. 2. FIG. 2 also shows agitator members 16 attached to the selector disk 14 and selective features (or openings) 18 contained within the selector disk 14. Selector disk 14 is affixed to the selector disk rotate motor and gearbox by disk knob 20 which can be manually removed to change out various selector disks having differently shaped and sized selective features (openings). Supporting structure 17 and adjuster feet 19 for the components of the apparatus used for sorting the sample containers are also shown in FIG. 2.

Figure 3:
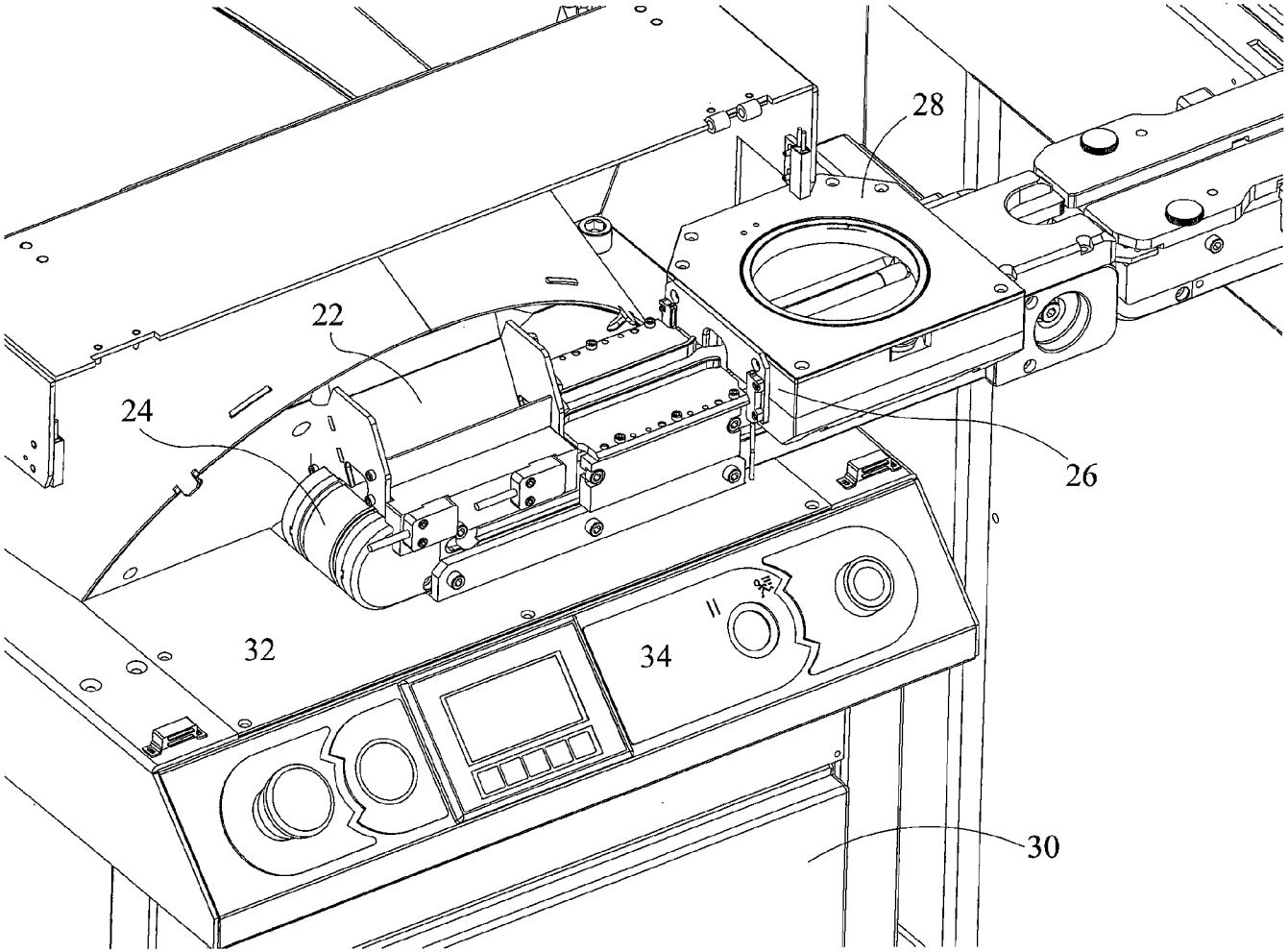
FIG. 3 is a front perspective view of a portion of the apparatus of the present invention for sorting and orienting sample containers which shows the output chute, output conveyer, scanning sensor, orientation device, and system controller enclosure of the apparatus.
Figure 4:
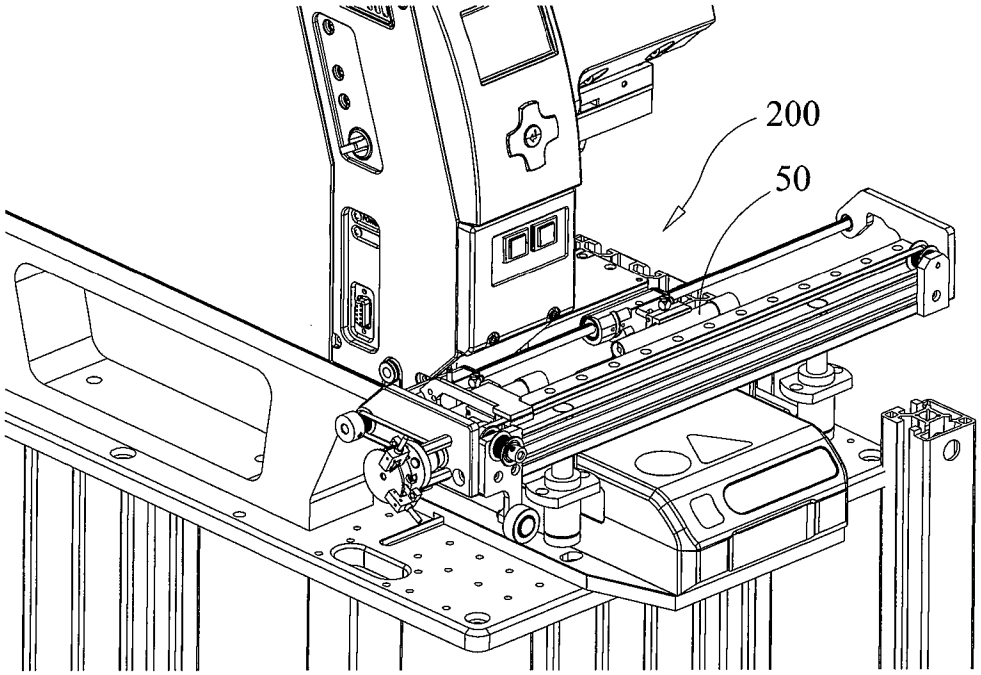
FIGS. 4 and 5 are front perspective views of portions of a device which is connected to the apparatus of the present invention for sorting and orienting sample containers which shows the sample containers being received after being sorted and oriented by the apparatus of the present invention.
Figure 5:
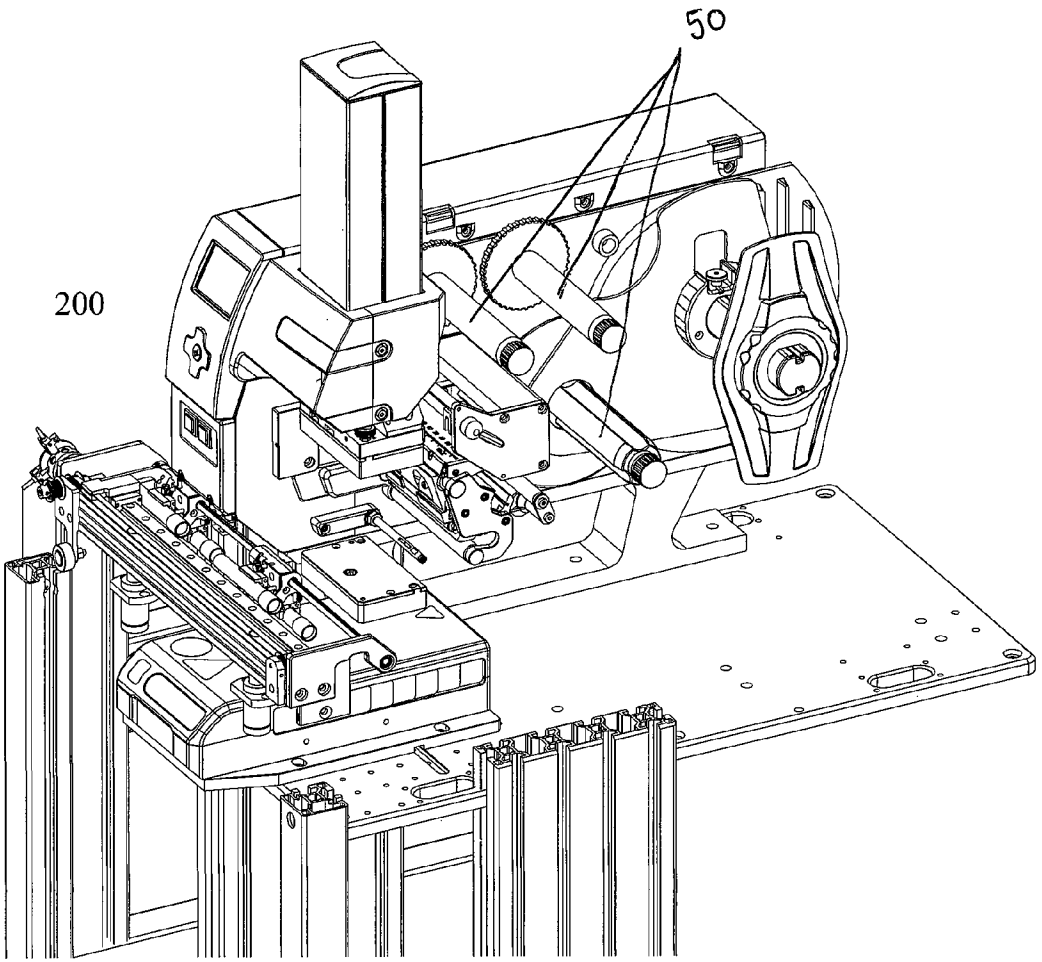

FIG. 3 is a front perspective view of a portion of the apparatus 10 of the present invention for sorting and orienting sample containers which shows the output chute 22, output conveyer 24, scanning sensor 26, orientation device 28, and system controller enclosure 30 of the apparatus 10. FIG. 3 also shows the selector disk rotate motor 32 and gear box 34. FIGS. 4 and 5 are front perspective views of portions of a device 200 which is connected to the apparatus 10 of the present invention for further processing, transporting, and/or storing of the sample containers which shows the sample containers 50 being received after being sorted and oriented by the apparatus 10 of the present invention.

Figure 6:
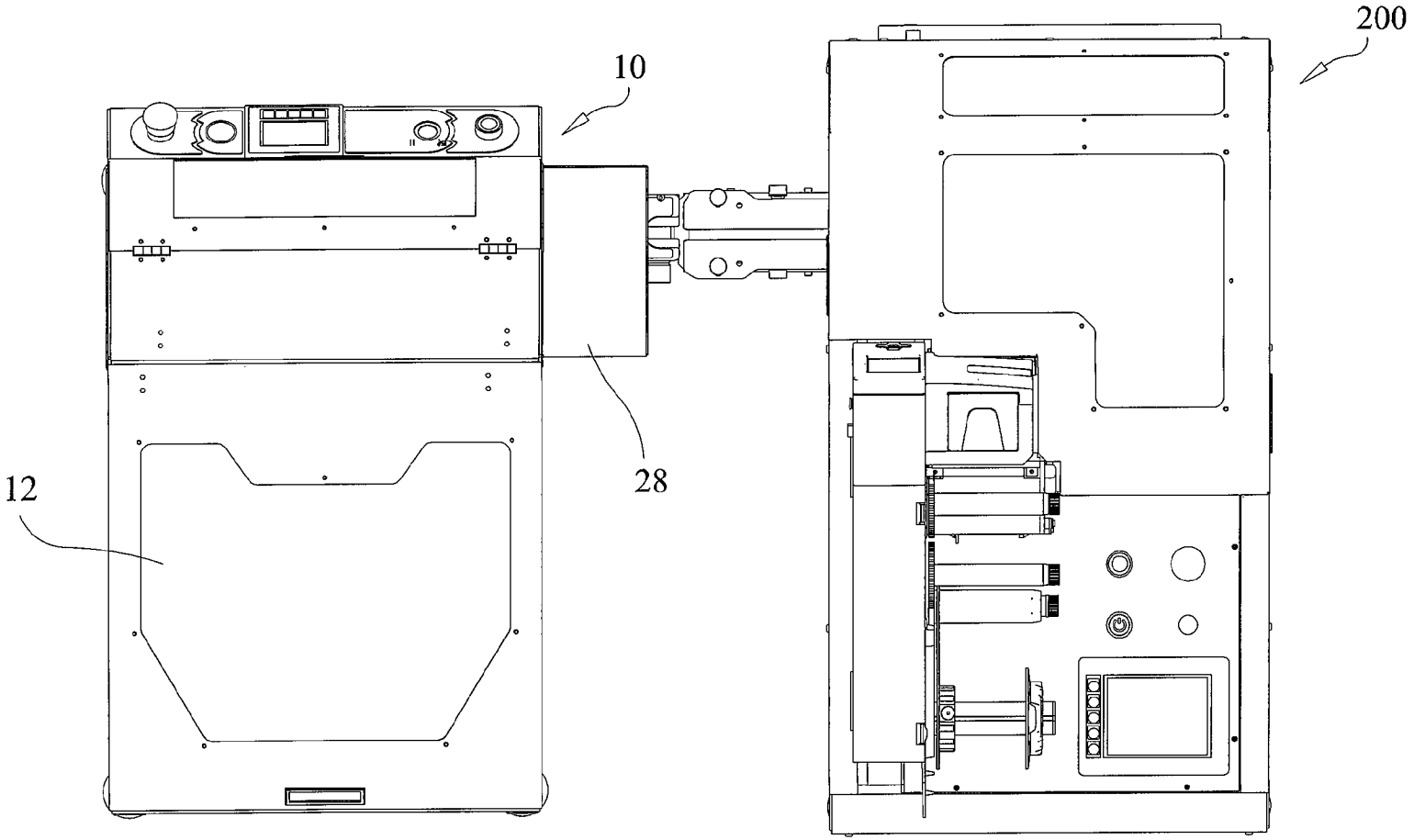
FIG. 6 is a top plan view of a schematic of the apparatus for sorting and orienting sample containers of the present invention shown connected to another device which receives the sample containers after they are sorted and properly oriented by the apparatus of the present invention.
Figure 7:
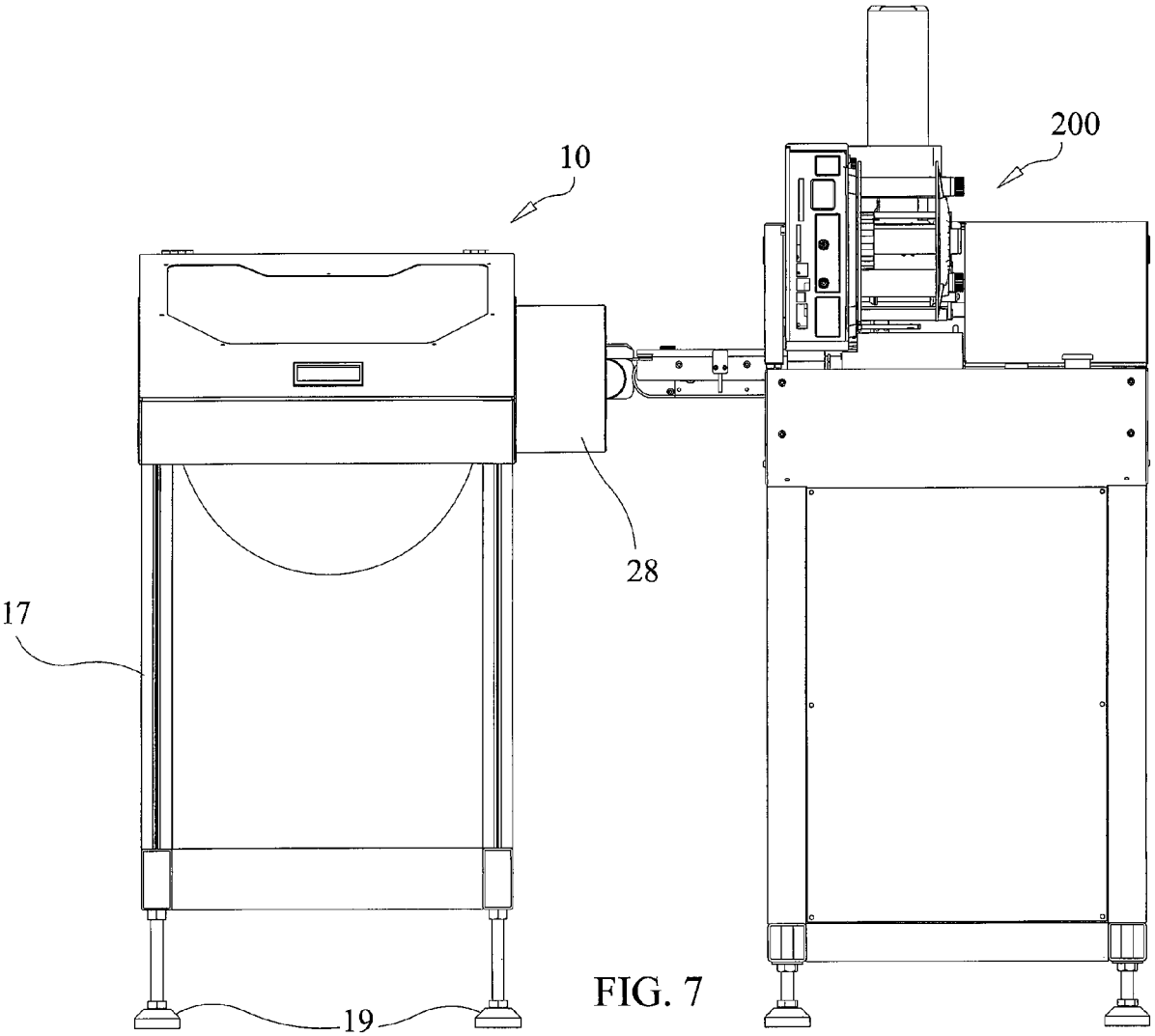
FIG. 7 is a front plan view of the schematic shown in FIG. 6 which shows the apparatus for sorting and orienting sample containers of the present invention shown connected to another device which receives the sample containers after they are sorted and properly oriented by the apparatus of the present invention.

A top plan view of a schematic of the apparatus 10 for sorting and orienting sample containers of the present invention shown connected to another device 200 which receives the sample containers after they are sorted and properly oriented by the apparatus 10 of the present invention is shown in FIG. 6. FIG. 7 is a front plan view of the schematic shown in FIG. 6 which shows the apparatus 10 for sorting and orienting sample containers of the present invention shown connected to another device 200 which receives the sample containers after they are sorted and properly oriented by the apparatus 10 of the present invention. FIGS. 6 and 7 show the positioning and orientation of the hopper 12 (as well other features of the apparatus 10 connected to the hopper 12 which are not all visible) in relation to the orientation device 28.

Figure 8:
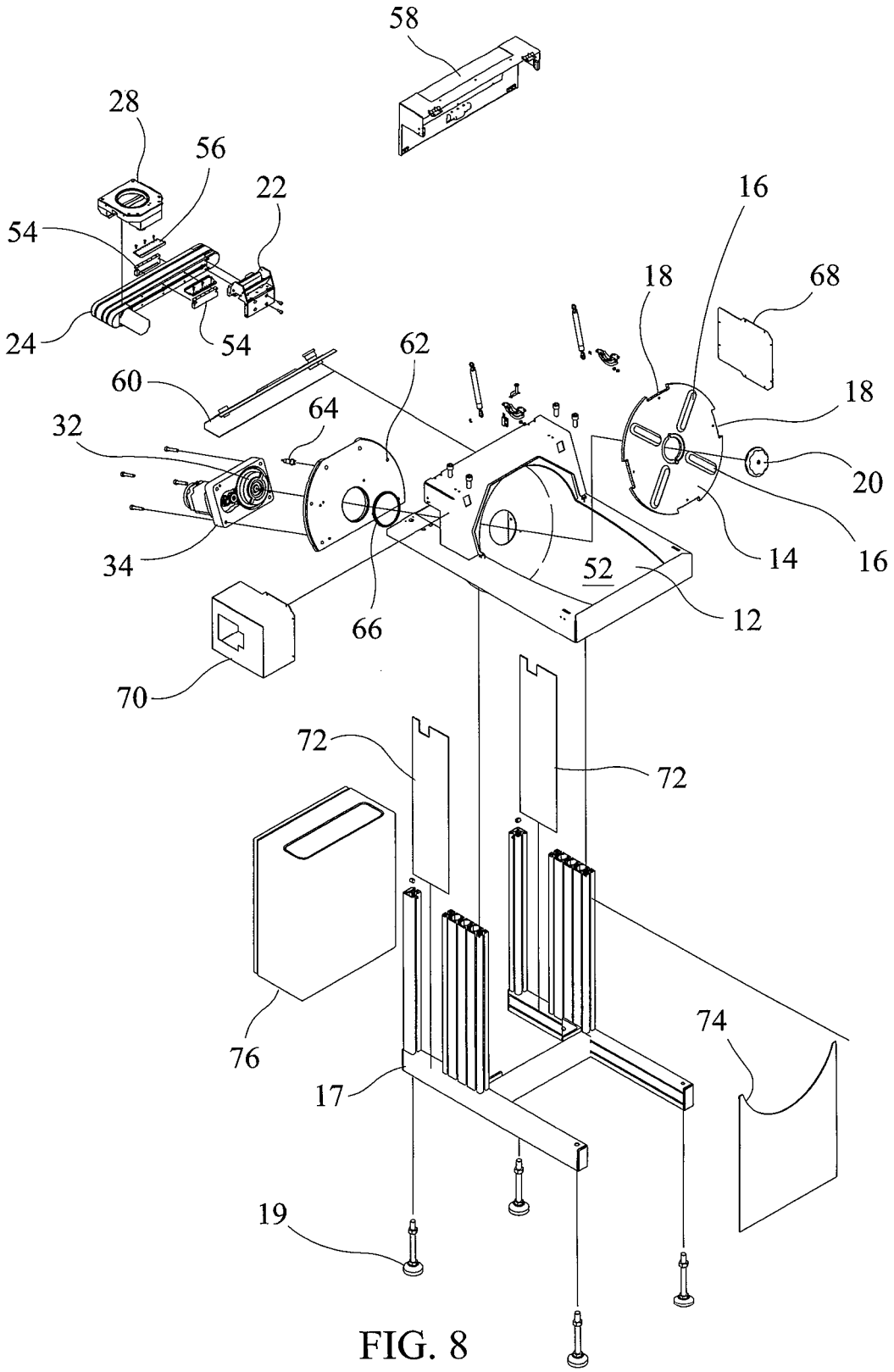
FIG. 8 is an exploded view of a portion of the apparatus for sorting and orienting sample containers of the present invention which shows the components of the apparatus used for sorting the sample containers.

FIG. 8 is an exploded view of a portion of the apparatus 10 of the present invention for sorting and orienting sample containers which shows the components of the apparatus used for sorting the sample containers. Hopper 12 includes a feeder bowl 52. Selector disk 14, having cut out notches or openings 18 about the circumference of the selector disk and agitator members 16 positioned about the radius of the selector disk, is connected to the hopper 12 with disk knob 20. Selector disk rotate motor 32 and gear box 34 drive the selector disk 14. Output chute 22 is connected to hopper 12 such that sample containers received in the output chute 22 are dropped onto output conveyer 24. A guide mount 54 and edge guide 56 are connected to output conveyer 24 to guide the sorted sample containers to orientation device 28. Other sorting components 10 of the apparatus can include a sorter rear cover 58, a sorter HMI assembly 60, a hopper back plate 62, a sensor 64 within the hopper back plate, a seal 66, a sorting blanking plate 68, sorter output cover 70, sorter covers 72, 74, enclosure 76, supporting structure 17, and adjuster feet 19.

Figure 9:
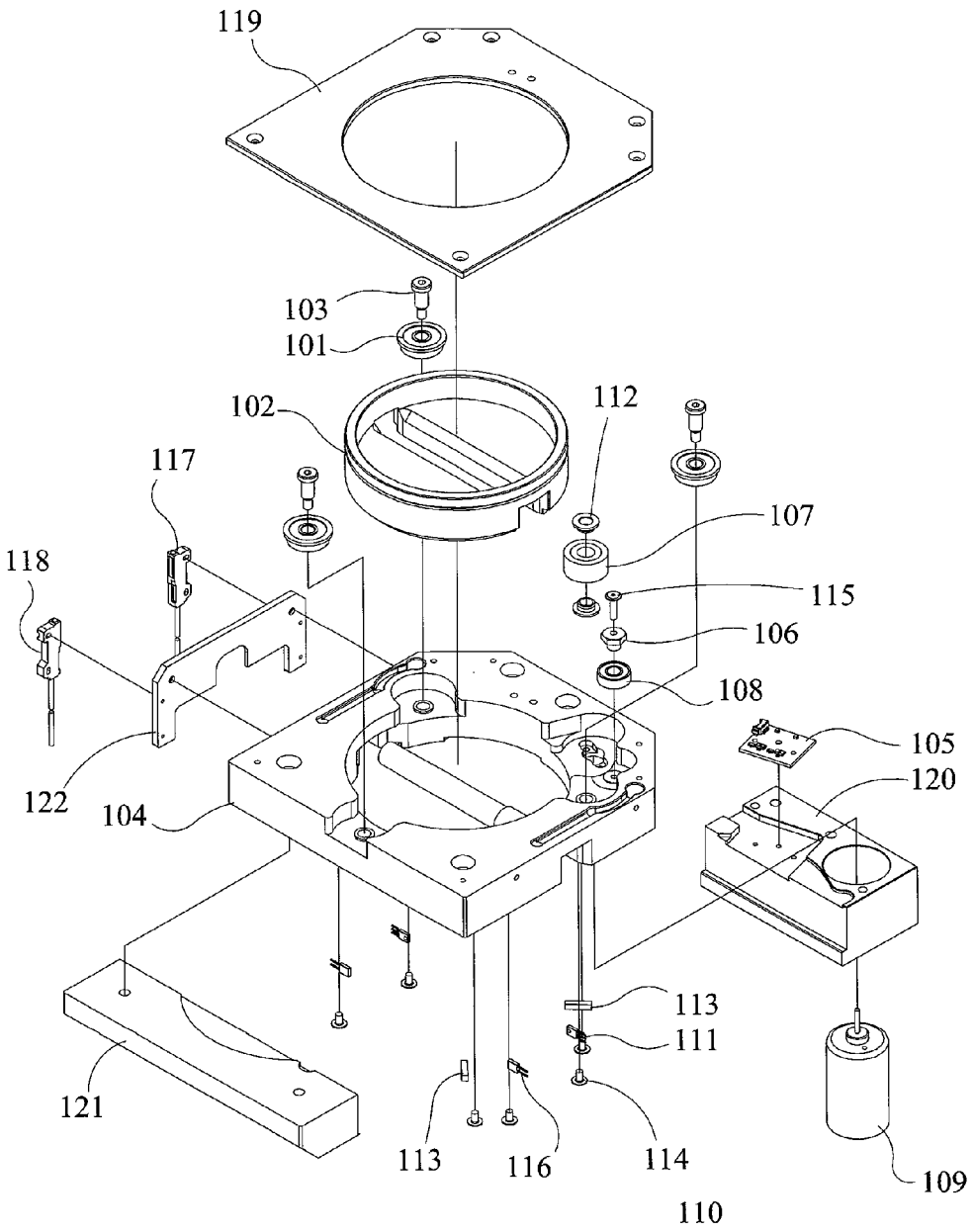
FIG. 9 is an exploded view of a portion of the apparatus for sorting and orienting sample containers of the present invention which shows the components of the apparatus used for orienting and/or aligning the sample containers after they are sorted by the apparatus.

FIG. 9 is an exploded view of a portion of the apparatus for sorting and orienting sample containers of the present invention which shows the components of the apparatus used for orienting and/or aligning the sample containers after they are sorted by the apparatus. This is one exemplary embodiment of the orientation device 28. The components of this embodiment are identified by item number and description as follows:

| Reference No. | Description |
|---|---|
| 101 | Ball Bearing |
| 102 | Rotate Chuck |
| 103 | Low Head Shoulder Bolt |
| 104 | Support Structure |
| 105 | Sensor Board |
| 106 | Eccentric Bushing |
| 107 | Roller |
| 108 | Deep Groove Ball Bearing |
| 109 | Motor |
| 110 | Motor Controller Card |
| 111 | Emitter Assy |
| 112 | Oil Free Bushing |
| 113 | Parallel Key |
| 114 | Bolt |
| 115 | Bolt |
| 116 | IR Transmitter |
| 117 | Fiber Optic |
| 118 | Fiber Optic |
| 119 | Rotate Top Cover |
| 120 | Rotate Fixed Mount |
| 121 | Rotate Clamp Body |
| 122 | Fender Sensor Bracket |

The system and apparatus for sorting/separating and orienting/aligning sample containers of the present invention is an independently operating system. Its operation is monitored and controlled by a System Controller with firmware/software written specifically to provide the necessary functions. The typical operation is as follows:

Operation of One Exemplary Embodiment

1) Initially an Operator must load the Hopper with a particular Sample Container/Tube or Vial type. All of the Tubes or Vials loaded must be of the same type and the Selector Disk that is installed must be designed for that Tube or Vial type.

2) The System Controller commands the Selector Disk to begin rotating by a motor.

3) As the Selector Disk rotates the Selector Features (Selector Openings) pass by a 'Part Present' sensor near the Output Chute location. If the Part Present sensor detects a Tube or Container is present in a Selector Feature (Opening) the Selector Disk will rotate until that Selector Feature (Opening) is aligned with the Output Chute position and will halt motion.

4) Another sensor is used to confirm that the Tube or Container falls from the Selector Feature (Opening) and onto the Output Chute.

5) The Tube or Container slides down the Output Chute and onto the moving Output Conveyor.

6) The Output Conveyor moves the Tube or Container toward the Orientator.

7) As the Tube or Container enters the Orientator it passes through a Scanning Sensor. The Scanning Sensor emits a field of light between a transmitter and a receiver element. The Scanning Sensor measures the amount of light passing between the two elements. The Scanning Sensor has previously been 'trained' to distinguish the two ends of the Tube or Container by the amount of light detected. Note: Typically the cap end of a Tube or Container is larger than the bottom end of a Tube or Container, with or without a cap.

8) The Tube or Container passes fully by the Scanning Sensor and into the Orientator (or Orientation Device).

9) If the Scanning Sensor determined that the Tube or Container is traveling in the wrong orientation the System Controller provides a signal to a motor that causes the Orientator to rotate 180 degrees. This rotation changes the orientation of the Tube of Container. If the Tube or Container was in the correct orientation then the Orientator does not rotate.

10) The Tube or Container exits the Orientator and continues to the end of the Output Conveyor.

11) Other devices or instruments can be connected to the Output Conveyor to receive the Tubes or Containers from the system and apparatus of the present invention.

12) The System Controller monitors and sequences Steps 2-5 and Steps 6-10 to provide the maximum possible feed rate for Tubes or Containers in a controlled fashion.

The present invention contemplates a system and apparatus for sorting sample containers which includes a plurality of interchangeable selector disks where each selector disk includes features or openings for only one shape and/or size of sample container. The present invention also contemplates including a plurality of interchangeable selector disks where each selector disk includes features or openings for more than one size and/or shape of sample container. In the case of utilizing a selector disk that includes features or openings for more than one size and/or shape of sample containers, the system and apparatus of the present invention may also include a sensor member that is capable of determining the different size and/or shape of sample containers being received from the output member (such as the output chute and/or output conveyer) and additional routing members such as additional conveyor members that can route the differently shaped and/or sized sample containers to different destinations. Once sorted by shape and/or size, the sample containers may then be further oriented and/or aligned in a predetermined orientation as previously described above with reference to other exemplary embodiments such as where the sample containers include stopper elements or cap elements.

The detailed description of exemplary embodiments of the invention herein shows various exemplary embodiments and the best modes, known to the inventor at this time, of the invention. These exemplary embodiments and modes are described in sufficient detail to enable those skilled in the art to practice the invention and are not intended to limit the scope, applicability, or configuration of the invention in any way. Rather, the following disclosure is intended to teach both the implementation of the exemplary embodiments and modes and any equivalent modes or embodiments that are known or obvious to those reasonably skilled in the art. Additionally, all included figures are non-limiting illustrations of the exemplary embodiments and modes, which similarly avail themselves to any equivalent modes or embodiments that are known or obvious to those reasonably skilled in the art.

Other combinations and/or modifications of structures, arrangements, applications, proportions, elements, materials, or components used in the practice of the instant invention, in addition to those not specifically recited, can be varied or otherwise particularly adapted to specific environments, manufacturing specifications, design parameters, or other operating requirements without departing from the scope of the instant invention and are intended to be included in this disclosure.

Unless specifically noted, it is the Applicant's intent that the words and phrases in the specification and the claims be given the commonly accepted generic meaning or an ordinary and accustomed meaning used by those of ordinary skill in the applicable arts. In the instance where these meanings differ, the words and phrases in the specification and the claims should be given the broadest possible, generic meaning. If any other special meaning is intended for any word or phrase, the specification will clearly state and define the special meaning.

The invention claimed is:

1. An apparatus for sorting sample containers comprising:
a hopper having a pass through opening;
at least one selector disk having at least one opening therein, said at least one selector disk being removably secured to the hopper;
an output member for receiving a sample container which passes through said at least one opening in said at least one selector disk and the pass through opening in the hopper; and
a scanning sensor capable of determining if the sample container is in a desired orientation after being received by the output member; and wherein said at least one selector disk comprises a plurality of exchangeable selector disk each having different sized opening contained therein.

2. The apparatus of claim 1 wherein said at least one opening in said at least one selector disk comprises a plurality of same sized openings positioned at evenly distributed locations about the circumference of said at least one selector disk.

3. The apparatus of claim 1 wherein said at least one opening in each of said plurality of exchangeable selector disks comprises a plurality of same sized openings positioned at evenly distributed locations about the circumference of each of said plurality of exchangeable selector disks.

4. The apparatus of claim 1 wherein the output member includes an output chute and an output conveyer.

5. The apparatus of claim 1 further comprising a selector disk rotate motor and gearbox for rotating said at least one selector disk.

6. The apparatus of claim 1 further comprising a disk knob to enable removal and installation of said at least one selector disk.

7. The apparatus of claim 1 wherein said at least one selector disk further includes at least one agitator member.

8. The apparatus of claim 7 wherein said at least one agitator member comprises a plurality of agitator members positioned at evenly distributed locations about the radius of said at least one selector disk.

9. The apparatus of claim 1 further comprising an orientation device capable of rotating the sample container to the desired orientation after being scanned by the scanning sensor.

10. The apparatus of claim 9 wherein the orientation device rotates the sample container 180 degrees in order to rotate the sample container to the desired orientation.

11. The apparatus of claim 9 further comprising a receiving apparatus for receiving sample containers in the desired orientation for further processing or for placing them within at least one of a storage and transport container.

12. The apparatus of claim 9 further comprising a system controller for controlling the apparatus.

13. The apparatus of claim 12 further comprising one or more sensors in communication with the hopper, and monitored by the system controller, to sense when a sample container passes through said at least one opening in said at least one selector disk and the pass through opening in the hopper.

14. The apparatus of claim 1 wherein said at least one selector disk includes two or more openings having at least one of a different size and a different shape.

15. The apparatus of claim 14 further comprising an additional one or more pass through members in the hopper and an additional one or more output members capable of receiving sample containers passing through said two or more openings in said at least one selector disk and the additional one or more pass through openings in the hopper, respectively, such that each output member receives a sample container having at least one of a specific size and a specific shape.

16. The apparatus of claim 15 wherein each of said output members comprises an output chute and an output conveyer.

17. The apparatus of claim 16 further comprising a scanning sensor for each output member wherein each scanning sensor is capable of determining if the sample container is in a desired orientation after being received by its respective output member.

18. The apparatus of claim 17 further comprising an orientation device for each scanning sensor wherein each orientation device is capable of rotating the sample container to a desired orientation after being received by the output member associated with the respective scanning sensor.

19. An apparatus for sorting sample containers comprising:
a hopper having a pass through opening;
a selector disk having at least one opening therein, said selector disk being removably secured to the hopper;
an output member for receiving a sample container which passes through said at least one opening in the selector disk and the pass through opening in the hopper;
a scanning sensor capable of determining if the sample container is in a desired orientation after being received by the output member; and
an orientation device capable of rotating the sample container to the desired orientation if the sample container is not positioned in the desired orientation.

20. The apparatus of claim 19 wherein said at least one opening in the selector disk comprises a plurality of same sized openings positioned at evenly distributed locations about the circumference of the selector disk.

21. The apparatus of claim 19 further comprising a plurality of exchangeable selector disks wherein each exchangeable selector disk has one or more same size openings that are different in size than the one or more same size openings in the other exchangeable selector disks.

22. The apparatus of claim 21 wherein each of the one or more same size openings in each of said plurality of exchangeable selector disks are positioned at evenly distributed locations about the circumference of their respective exchangeable selector disk.

23. The apparatus of claim 19 further comprising a system controller for controlling the apparatus.

24. An apparatus for sorting sample containers comprising:
a hopper having a pass through opening;
a plurality of disk selectors each having at least one opening therein, each of said plurality of disk selectors being removably securable to the hopper; and
an output member for receiving a sample container which passes through said at least one opening in the plurality of disk selectors and the pass through opening in the hopper; and a scanning sensor capable of determining if the sample container is in a desired orientation after being received by the output member; and wherein the at least one selector disk comprises a plurality of exchangeable selector disks each having a different sized opening contained therein.

* * * * *